US011753285B2

(12) United States Patent
Fäßler et al.

(10) Patent No.: US 11,753,285 B2
(45) Date of Patent: Sep. 12, 2023

(54) DEVICE FOR PARKING VEHICLES

(71) Applicant: Klaus Multiparking GmbH, Aitrach (DE)

(72) Inventors: Norbert Fäßler, Haslach (DE); Dieter Melder, Türkheim (DE)

(73) Assignee: Klaus Multiparking GmbH, Aitrach (DE)

( * ) Notice: Subject to any disclaimer, the term of this patent is extended or adjusted under 35 U.S.C. 154(b) by 375 days.

(21) Appl. No.: 16/958,869

(22) PCT Filed: Dec. 27, 2018

(86) PCT No.: PCT/EP2018/097030
§ 371 (c)(1),
(2) Date: Jun. 29, 2020

(87) PCT Pub. No.: WO2019/129813
PCT Pub. Date: Jul. 4, 2019

(65) Prior Publication Data

US 2020/0339398 A1 Oct. 29, 2020

(30) Foreign Application Priority Data

Dec. 28, 2017 (DE) ..... 202017107934.1
Dec. 21, 2018 (DE) ..... 202018107407.5

(51) Int. Cl.
*B66F 7/22* (2006.01)
*B66F 7/02* (2006.01)
(Continued)

(52) U.S. Cl.
CPC ..... *B66F 7/22* (2013.01); *B66F 7/02* (2013.01); *E04H 6/06* (2013.01); *E04H 6/181* (2013.01)

(58) Field of Classification Search
CPC ..... B66F 7/02; B66F 7/04; B66F 7/22; B66F 7/28; B66F 9/00; E04H 6/06; E04H 6/065;
(Continued)

(56) References Cited

U.S. PATENT DOCUMENTS 5,129,483 A 7/1992 Nussbaum
6,478,530 B2 * 11/2002 Patrito ..... B65G 49/0454 414/678
(Continued)

FOREIGN PATENT DOCUMENTS

DE 4018726 A1 1/1992
DE 4321914 A1 1/1995
(Continued)

OTHER PUBLICATIONS

DE202005020270—Machine Translation (Year: 2007).*
(Continued)

*Primary Examiner* — Lee D Wilson
*Assistant Examiner* — Alberto Saenz
(74) *Attorney, Agent, or Firm* — REISING ETHINGTON, P.C.

(57) ABSTRACT

A device for parking vehicles includes a platform a synchronization traction element on each side on the platform. One end of each traction element is fixed in a first region of the platform, and another end of each traction element is fixed in an opposite second region of the platform. Each traction element has a first part in the first region of the platform, a second part along the platform, and a third part in the second region of the platform. Each traction element is guided by a roller, and the rollers are connected by a synchronization shaft.

15 Claims, 4 Drawing Sheets

(51) Int. Cl.
*E04H 6/06* (2006.01)
*E04H 6/18* (2006.01)

(58) Field of Classification Search
CPC .... E04H 6/08; E04H 6/12; E04H 6/14; E04H 6/18; E04H 6/181; E04H 6/188; E04H 6/26; E04H 6/38; E04H 6/282; E04H 12/344
USPC ..... 414/228, 234, 239, 678; 248/317
See application file for complete search history.

(56) References Cited

U.S. PATENT DOCUMENTS

| | | | | |
|---|---|---|---|---|
| 8,371,793 | B2 * | 2/2013 | Faßler | E04H 6/065 414/229 |
| 2010/0089845 | A1 * | 4/2010 | Fassler | B66F 7/04 211/1.57 |

FOREIGN PATENT DOCUMENTS

| | | | | | |
|---|---|---|---|---|---|
| DE | 202005020270 | U1 | | 5/2007 | |
| DE | 202005020270 | U1 | * | 6/2007 | E04H 6/06 |
| DE | 202008017198 | U1 | | 3/2009 | |
| DE | 102012009330 | A1 | | 11/2013 | |
| FR | 1183686 | A | * | 10/1957 | |
| FR | 1183686 | A | | 7/1959 | |
| GB | 2268467 | A | * | 1/1994 | B65G 69/24 |
| JP | 2001207666 | A | | 8/2001 | |

OTHER PUBLICATIONS

FR1183686—Machine Translation (Year: 1957).*
International Search Report for International Application No. PCT/EP2018/097030 dated Apr. 5, 2019 (10 pages).
English Translation of International Search Report for International Application No. PCT/EP2018/097030 dated Apr. 5, 2019 (2 pages).
German Search Report for German Application No. 20 2017 107 934.1 dated Nov. 23, 2018 (6 pages).
European Office Action for European Application No. 18 836 268.5-1017 dated Jan. 27, 2023 (4 pages).

* cited by examiner

DEVICE FOR PARKING VEHICLES

INTRODUCTION

The disclosure relates to a device for parking a plurality of vehicles or the like on top of one another, wherein at least one platform which is able to be lifted and lowered by a lifting installation is provided.

In devices of this type, which serve in particular for parking motor vehicles but may also be used for other storage purposes, one lifting installation is in each case often provided on both sides of the platform. In addition to the two lifting installations, the use of a synchronization installation which ensures that the lifting forces on both sides of the platform carry out in each case the same lifting movement is furthermore known. Such a synchronization installation is configured, for example, as a flow divider for controlling the supply to the lifting installation which is configured as a hydraulic lifting means.

Such flow dividers are usually equipped with magnetic valves and a high complexity in terms of construction results in such systems in order for a jolt-free, that is to say uniform, lifting or lowering movement of the platform to be implemented.

SUMMARY

The disclosure is therefore based, per an embodiment, on the object of improving this prior art and of in particular setting forth a proposal for improving the synchronous running, thus the same movement, of at least two points which lie on opposite sides of the platform.

In order for this object to be achieved, per an embodiment, the disclosure proceeds from a device as described at the outset, and proposes that one synchronization traction element is in each case provided so as to be lateral on the platform, said synchronization traction element by way of a first part in a first region of the platform extending across a central, second, part running on the platform to a third part and to a second region of the platform that is opposite the first region, and said synchronization traction element by way of one end thereof being fixed in the first region and by way of the other end thereof being fixed in the second region, wherein each synchronization traction element is guided on the platform by at least one roller and the rollers of both synchronization traction elements are rotationally connected by way of a synchronization shaft.

The synchronization traction element on the device typically extends from the front to the rear so as to be parallel to the longitudinal axis of the parking spaces implemented on the platform, this typically corresponding to the direction of entry and exit of the vehicles onto and from the platform, respectively. However, the disclosure is not limited to this arrangement; the synchronization traction element on the platform can also be guided so as to be orthogonal thereto, thus orthogonal to the longitudinal axis of the parking spaces.

It is therefore suitable that the first region, where the first part of the synchronization traction element is, means the rear end of the platform which faces away from the entry region, for example, or means the left side, for example. Consequently, the second region of the platform is in this instance the front side which faces the access region, or the right side of the platform, the second region thus being opposite the first region.

The arrangement herein is chosen such that one synchronization traction element is provided on each side of the platform. The platform herein supports on each side at least one roller for each synchronization traction element, said rollers being rotationally connected to one another by the synchronization shaft. It is provided herein that the rollers are secured on the synchronization shaft, the mutual angular position of said rollers therefore not being variable. It is suitable that the synchronization shaft herein is mounted and held so as to be rotatable on the platform, preferably on the lower side of the latter. However, the disclosure also comprises proposals in which the synchronization shaft is disposed so as to be rotatably mounted on the upper side of the platform, for example so as to be protected in a housing.

The platform on the sides thereof expediently has at least one further roller for guiding the synchronization traction element; however the use of at least one roller is sufficient according to the disclosure—the guiding task at another location of the platform may also be implemented by other elements. Said other elements can be, for example, guide rails which are angled or radiused and cause the synchronization traction element to be deflected, or else simple rollers.

The effect of the disclosure now is such that the length of the first and the third parts of the synchronization traction elements are variable when lifting or lowering, and a relative movement of the synchronization traction element in terms of the respective roller results on account thereof. The lifting or lowering movement thus leads to a relative movement of the synchronization traction element in terms of the respective roller. This relative movement leads to a rotation of the roller. Since the two rollers of the respective synchronization traction elements are rotationally connected to one another by the synchronization shaft (the rollers are fastened so as to be rotationally fixed on the synchronization shaft, and the synchronization shaft is rotatably mounted), synchronizing of the respective movements of the two sides, for example the left and the right side, or the front and the rear side, of the platform takes place automatically.

On account of the synchronization shaft, the respective lifting or lowering movements of the two mutually opposite sides of the platform are mechanically fixedly coupled to one another, and a movement of the platform free of jolting and canting is achieved by way of simple mechanical means at low implementation costs. This surprisingly simple mechanical solution is very easy to service and repair; complex adjusting jobs as in the case of the flow dividers in hydraulic lifting installations described at the outset can be avoided. The solution according to the disclosure, per an embodiment, furthermore also does not rely on further elements which are attached in a locationally fixed manner. The synchronization shaft simply engages in the synchronization traction elements which are provided for the synchronous movements of the front and the rear end of the platform, and thus additionally ensures a synchronous movement of the right and the left side of the platform. On account of this combination of functions, components are saved in comparison to separate solutions. The synchronization traction element moves conjointly with the platform. As the vertical height of the platform increases, the vertically running first part of the synchronization traction element also becomes longer or higher, respectively. On account of the combination of the functions of the synchronization in the longitudinal direction and the synchronization in the transverse direction of the platform, the counterpart of the synchronization shaft, i.e. the synchronization traction element, conjointly with the synchronization shaft travels in the vertical direction. In solutions in which the synchronization shaft engages in a counterpart which is attached in a locationally fixed manner, for example a rack, this locationally fixed counterpart would have to extend across the entire height of movement of the parking device. The locationally fixed counterpart required in this case thus would have long dimensions, this in turn setting high requirements in terms of the dimensional accuracy and precision of said counterpart. Locationally fixed counterparts dimensioned in such a large manner are complex to produce and cost intensive. The solution according to the disclosure, without a locationally fixed counterpart, is thus less prone to malfunctioning and can be produced in a more cost-effective manner.

In one embodiment of the proposal it is provided that at least one end of the synchronization traction element is fixed to the building where the device is installed.

Alternatively it is provided that at least one end of the synchronization traction element is fixed to the device.

It is suitable herein that the free end of the synchronization traction element is fixed so that the tensile forces acting in said synchronization traction element can be dissipated to the device or to the building, for example. The previously described variants exist to this end, which are to be used depending on the specific conditions. The proposal that at least one end of the synchronization traction element is fixed to the device is favorable herein, as such a solution can be used independently of the embodiments on the building, but said solution may potentially be somewhat more complex since corresponding provisions therefor have to be made on the device.

It is furthermore provided, per an embodiment, in the proposal that at least one end of the synchronization traction element is fixed to the lifting installation, in particular to the movable part of the lifting installation. The lifting installation often already possesses a corresponding fastening footplate by way of which said lifting installation is set up on the floor of the building. The one end of the synchronization traction element in this instance is thus conjointly fastened to said element. Said element in this instance is often an immovable part of the lifting installation. The proposal according to the disclosure however is not limited to this concept but also comprises solutions in which the synchronization traction element is fixed to the movable part of the lifting installation and thus participates in the lifting or lowering movement of the platform, for example.

It is furthermore provided, per an embodiment, that the lifting installation is located at one end of the platform and the synchronization shaft is provided in the region of the lifting installation. The arrangement is often chosen such that the platform has an access region on one side, the arrangement of the lifting installation thus interfering on said front side, which is why the lifting installations are preferably positioned toward the rear side, i.e. the region which faces away from the access region. For the purpose of servicing it is therefore favorable, per an embodiment, for the synchronization shaft to also be disposed in this region. However, this does not preclude any other arrangement in such a manner that the synchronization shaft is located on the other side of the platform and the platform in this instance is disposed substantially between the synchronization shaft and the lifting installation.

In one embodiment it is provided that the device has a lifting installation which is preferably disposed so as to be central. Alternatively, it is provided that the device has (at least) two lifting installations and the platform is located between the two lifting installations. The necessary lifting work has to be performed by the lifting installation. It is often more favorable herein for a plurality of lifting installations to be provided in a redundant manner and thus for smaller lifting installations which are often able to be produced in greater volumes to be used, this lowering the overall costs. The platform herein is expediently disposed between the lifting installations so as to introduce the lifting forces into the platform in an ideally symmetrical manner, this facilitating the synchronization. However, the proposal according to the disclosure is not limited to such a variant; the proposal also comprises the arrangement of a single central lifting installations for the platform. Such a proposal is suitable in applications where space is critical, for example. At the same time, connection parts to the hard surface and to the platform are saved when providing a single lifting installation or a single lifting element.

It is expediently provided, per an embodiment, that the lifting installation is formed by a lift drive and a lifting means on which the lift drive acts or which interacts with the lift drive. A motor, in particular an electric motor, is often used as the lift drive. The lifting means is the means which actually carries out the linear movement, i.e. the lifting and lowering movement, in a manner supported by the motor.

In one embodiment it is provided that the lifting means engages directly or indirectly on the platform or on a movable part of a frame that supports the platform. The device often comprises a frame which supports at least one platform, or else optionally a plurality of platforms beside and/or on top of one another. The arrangement herein is chosen such that the frame comprises movable parts which are correspondingly moved by the lifting installations. To this extent, when mention is made by a movement of the platform by the lifting means, this in an equivalent manner also comprises solutions in which the means engage on the movable parts of a frame, said movable parts in turn holding and supporting the platform.

It is furthermore provided, per an embodiment, that the lift drive is a pinion or a roller driven by an electric motor. Alternatively, it is provided that the lift drive is a hydraulic pump and/or a hydraulic motor.

It is provided, per an embodiment, that the lifting means is an operating cylinder. For example, the arrangement is chosen such that the operating cylinder by way of the piston rod thereof is connected directly with the platform, or to a movable part of the frame that supports the platform, and thus imposes the lifting force directly on the platform. It is also provided that the lifting means is a rack which is combined with the rotating pinion.

In the proposal it is furthermore provided, per an embodiment, that the lifting means is formed by a combination of a traction element and an operating cylinder. A flexible element which extends across comparatively large lengths and which is capable of transmitting tensile forces is provided as a traction element. This includes, for example, a chain, a belt, a rope, or similar.

In one embodiment of the proposal it is provided that the piston rod of the operating cylinder supports a deflection roller or similar for the traction element, and the one end of the traction element is fixed to the building which receives the device or to the device, and the other end is fixed to the platform or to the movable part of a frame that supports the platform. The combination of a traction element and an operating cylinder permits the implementation of a hoist in a simple manner.

It is furthermore provided, per an embodiment, that at least one part of the synchronization traction element for lifting and lowering the platform interacts with the lifting installation. This dual function saves components and renders the entire proposal more cost-effective.

For example, it is thus provided, per an embodiment, that the piston rod of the operating cylinder supports a deflection roller or similar for the traction element, and the ends of the traction element are fixed to the building which receives the device or to the device, and the synchronization traction element is part of the traction element. A combined traction/synchronization traction element is proposed by way of this variant. The platform, by way of a plurality of rollers, rests in a loop of the combined traction/synchronization traction element and is lifted or lowered by the movement of the piston rod of the operating cylinder, i.e. the corresponding movement of the direction of the piston rod. Two rollers, in each case one roller on each side of the platform, herein are connected by the synchronization shaft and thus ensure a jolt-free synchronous movement of the platform in the device.

The rollers herein are rigidly assembled, i.e. so as to be at a fixed angle on the synchronization shaft, in such a manner that said rollers cannot be rotated relative to one another. In order for the construction of the parking device to be facilitated, it is provided that a setting possibility by way of which the synchronized running between the left and the right side of the platform can be set or readjusted is provided. For example, it can thus be provided that at least one roller is designed so as to be adjustable in terms of the rotational alignment thereof in relation to the other roller. This can take place, for example, by way of a toothing between the synchronization shaft and the roller. Alternatively, the clamping or fastening point of the synchronization traction element can be embodied so as to be variable relative to the immovable part of the device, for example by providing a threaded bar at the end of the synchronization traction element, said threaded bar by way of nuts being connected in an axially adjustable manner to the stationary part of the device.

In one embodiment it is provided that the synchronization traction element is configured as a chain, in particular as a traction chain. The same lift element is configured as a flexible movable component. Besides a chain, the design embodiment as a rope, tape, belt, etc., is also conceivable.

It is expediently provided, per an embodiment, that the roller is configured as a pinion or a chain wheel. Such a design embodiment is favorable in particular with a chain as a synchronization traction element, since a form-fitting connection between said two force-transmitting elements is possible on account thereof.

It is also to be noted that the wording "platform capable of lifting and lowering" of course does not refer to said two movements being simultaneous but to the platform being mounted such that said platform can be lifted or lowered, depending on the specific application.

In one embodiment it is provided that the platform on the sides thereof in the respective end region has in each case one front roller and one rear roller, and the lifting installations is disposed in the region of the rear roller, and the first part of the synchronization traction element from a fixing point in the rear region extends upward to the rear roller, the second part of the synchronization traction element extends between the rear roller and the front roller, and the third part from the first roller extends upward to a further fixing point, and the synchronization shaft connects the two rear roller to one another.

The embodiment described here is implemented in FIG. 1, for example, without however reducing the subject matter worded here to said depicted illustration. The terms up or down, respectively, are not to be understood strictly as being the plumb-line vertical direction but of course also comprise oblique lines which have a corresponding vertical proportion. It is suitable in this embodiment that the same lift element is separate from the embodiment of the lifting installations.

In one embodiment it is provided that the platform on the sides thereof in the respective end region has in each case one front roller and one rear roller, and the lifting installations is disposed in the region of the rear roller, and a combined traction/synchronization traction element which is part of the lifting installations and from a fixing point by way of a deflection roller of the operating cylinder of the lifting installations is guided from above to the rear roller and thus forms the first part of the synchronization traction element, the second part of the synchronization traction element extends between the rear roller and the front roller, and the third part from the front roller extends upward to a further fixing point, and the synchronization shaft connects the two rear roller to one another.

The embodiment described here is implemented in FIG. 2, for example, but without reducing the subject matter worded here to said depicted illustration. The terms up or down, respectively, are not to be understood strictly as being the plumb-line vertical direction but of course also comprise oblique lines which have a corresponding vertical proportion. It is suitable in this embodiment that the combined traction/synchronization traction element is guided in the manner of a loop and the platform by way of the rollers thereof provided at the four corners lies in said loop and is very positively guided.

It is expediently provided, per an embodiment, that the centrally disposed lifting installation is connected to the platform at the rear region of the latter, and one holding point which is provided for direction force from the lifting installation into the platform is in particular disposed so as to be centric between the longitudinal sides of the platform.

In one embodiment it is provided that the platform on the sides thereof in the respective end region has in each case one front roller and one rear roller, and a deflection piece is provided between the rear roller and the rear end of the platform, and the lifting installation is disposed in the region of the deflection piece, and the first part of the synchronization traction element from a fixing point in the rear region extends upward to the deflection piece, the second part of the synchronization traction element extends between the deflection piece and the front roller, wherein the second part of the synchronization traction element between the deflection piece and the front roller is connected to the rear roller and is operatively connected to the latter, and the third part from the front roller extends upward to a further fixing point, and the synchronization shaft (5) connects the two rear roller to one another.

BRIEF DESCRIPTION OF THE FIGURES

The disclosure is in particular schematically illustrated in an exemplary embodiment in the drawing in which.

DETAILED DESCRIPTION

Identical or mutually equivalent elements are in each case provided with the same reference signs in the figures and, unless expedient, are therefore not described once again. The disclosures contained in the entire description can be applied in analogous manner to identical parts having identical reference signs or identical component descriptions, respectively. Also, the positional indications chosen in the description, such as top, bottom, lateral, etc., for example, refer to the figure directly described and illustrated and in the case of a modified position are to be applied in analogous manner to the new position. Furthermore, individual features or combinations of features from the various exemplary embodiments shown and described may represent independent inventive solutions or solutions according to the disclosure.

Figure 1:
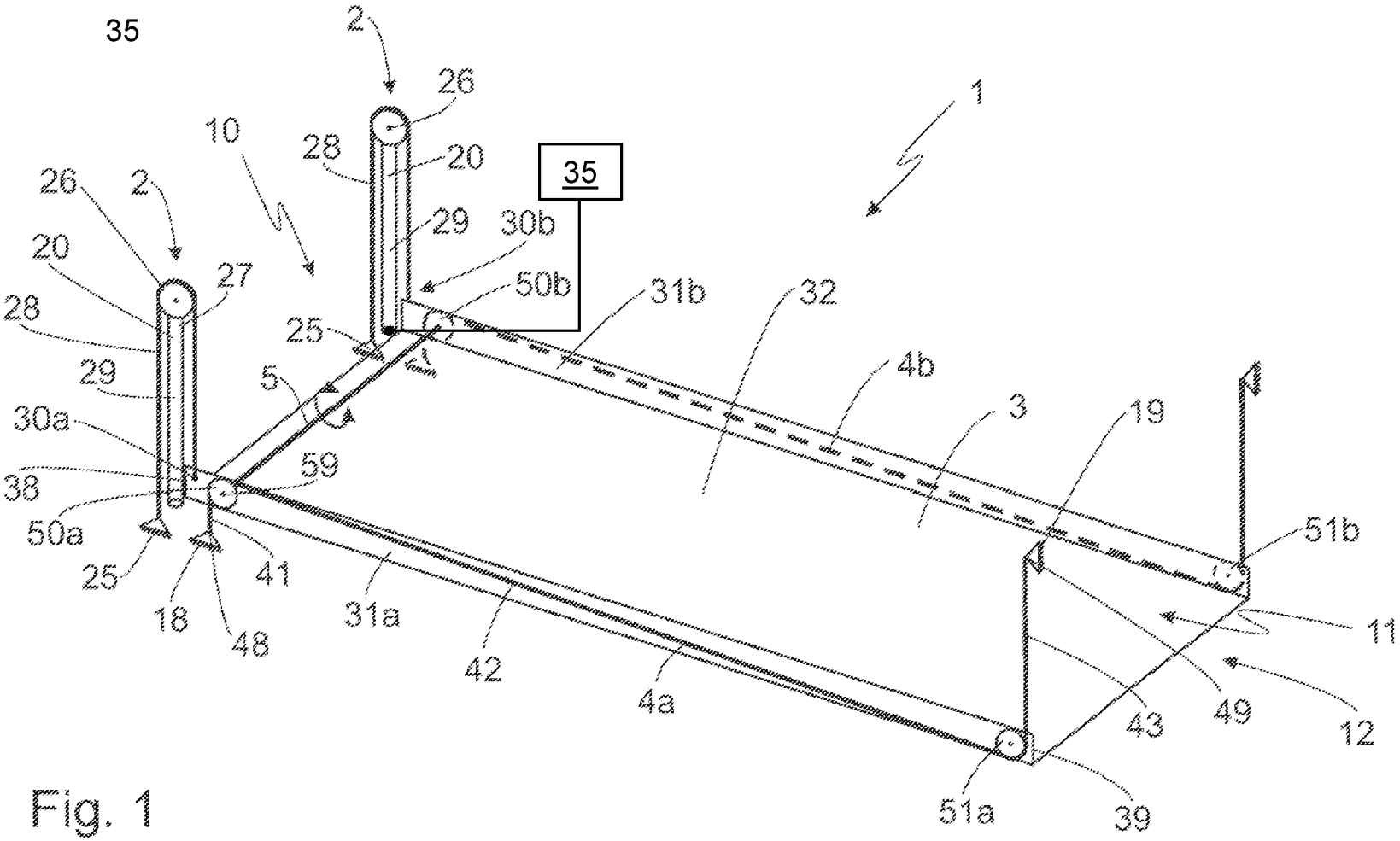
FIGS. 1 and 2 show in each case an exemplary embodiment of the device according to the disclosure in a schematic three-dimensional view.
Figure 2:
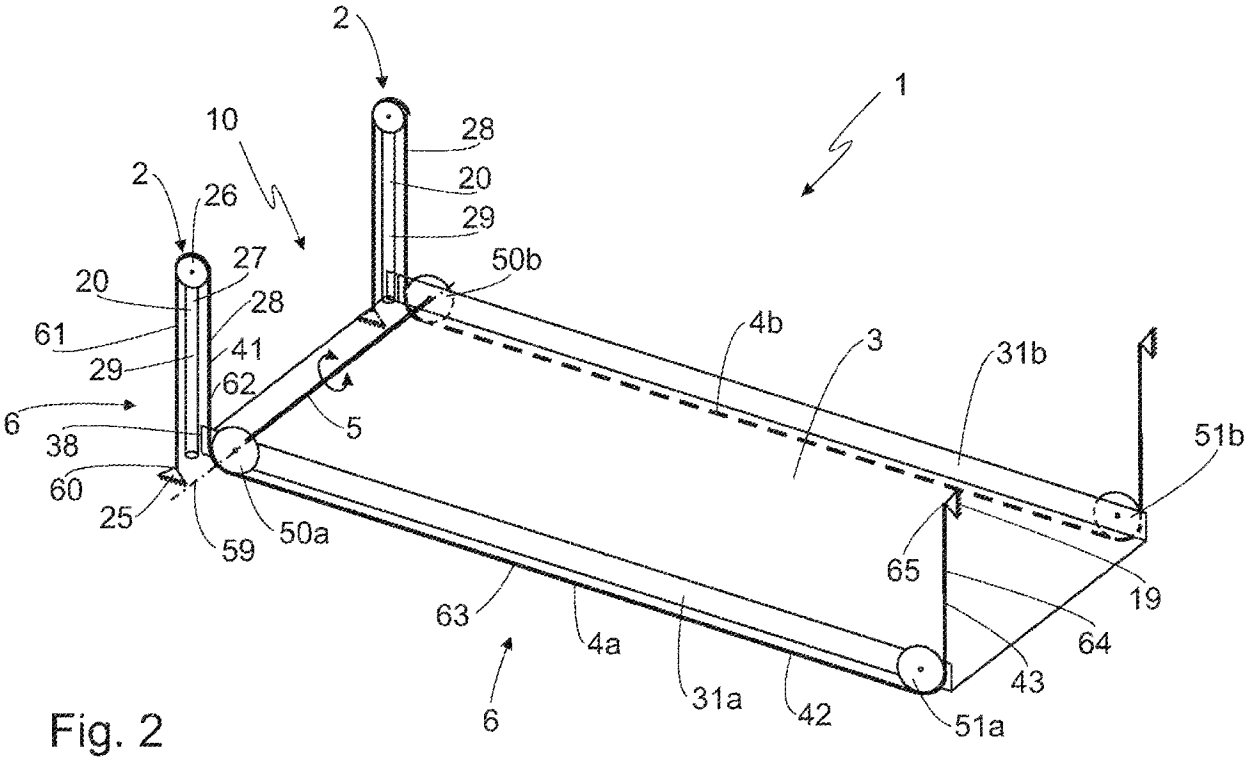

The construction of the device 1 according to the disclosure is substantially identical in both FIGS. 1, 2. The device 1 possesses two lifting installations 2 which are disposed in the first, rear, region 10 behind the platform 3. The access region 12 for parking or removing a vehicle to be parked on the platform 3 is also located in the second, front, region 11. It is to be noted that the disclosure of course also comprises another allocation, that is to say that it is possible for the lifting installations 2 to be located in the front region 11, thus in the access region 12, in a variant of the disclosure.

The two lifting installations 2 herein engage on the respective holding points 30*a* and 30*b* of the platform 3. The holding points 30*a* and 30*b* herein are provided on site stands 31*a* and 31*b* which therebetween receive the platform face 32. The site stands 31*a* and 31*b* herein possess a specific vertical height so as to impart stability to the platform 3 and also offer space for receiving additional elements such as, for example, the holding points 30*a* and 30*b*, or the rollers 50*a*, 50*b*, respectively.

The lifting installations 2 are of identical construction. Said holding points 30*a* and 30*b* herein are provided very much at the end, in particular in the rear region 10, of the platform 3. In the exemplary embodiment shown here, the lifting installation 2 is formed by a lift drive 35 and a lifting means 20 on which the lift drive acts. A hydraulic operating cylinder 29 is provided herein as the lifting means 20. The lift drive 35 herein is configured as a hydraulic pump, for example, which is driven by a motor, for example an electric motor. The piston rod 27 of the operating cylinder 29 herein supports a deflection roller 26 by way of which a traction element 28 is guided. The one end of the traction element 28 is established at the respective holding point 30*a* and 30*b* of the platform 3 and is capable of directing the corresponding lifting forces into the platform 3. The other end of the traction element 28 is fixed at the fixing point 25, for example on the building or the device 1.

The traction element 28 is capable of bearing tensile forces and of flexibly deflecting, such as a chain, belt, rope, steel cable, tape, or similar, for example. A chain is used as the traction element 28, and the deflection roller 26 is a chain wheel or a pinion on account of which a form-fitting connection results, on the one hand, and the traction element 28 is also reliably guided, on the other hand.

In the exemplary embodiment shown in FIG. 1, the fixing point 25 is located on the floor on which the operating cylinder 29 is also set up. It has already been explained that the fixing point 25 is located on the floor of the building which receives the device 1 or on the device 1 per se. The fixing point 25 herein does not mandatorily have to be provided on the floor, but in the lowered position of the device 1, thus in a position in which the platform 3 is in the lowest position, should still be located below the deflection roller 26.

In a lifting or lowering movement, the end of the traction element 28 that is connected to the holding point 30*a*, 30*b* of the platform 3 moves in a manner corresponding to the position of the piston rod 27 and correspondingly lifts or lowers the platform 3, respectively.

As can be seen from FIG. 1 or FIG. 2, respectively, one lifting installation 2 is provided only in one region, in this case in the rear region 10. In order for the front region 11 to also be lifted in the same manner, the synchronization traction element 4*a*, 4*b* is provided.

The construction of the synchronization traction elements 4*a*, 4*b* is identical and is therefore described only for one side.

The synchronization traction element 4*a*, 4*b* is divided into three different parts 41, 42, 43.

The first part 41 is located in the rear region 10 of the platform 3 and from a first end 48 extends in the (substantially) vertical direction up to a first roller 50*a* (hereunder also referred to as the rear roller 50*a*). The first end 48 herein is secured in the fixing point 18 on the floor of the pit of the building. The first roller 50*a* herein is located in the rear region 10 of the platform 3. The holding point 30*a* of the platform 3 on which the traction element 28 is established is located between the terminal edge 38 of the platform 3 and the first roller 50*a*.

The fixing point 18 can be located on the floor of the pit of the building, as is illustrated here. However, said fixing point 18 can also be disposed on the device 1 per se, for example on an enlarged foot plate which also supports the operating cylinder 29. The vertical position of the fixing point 18 herein is chosen such that the fixing point 18 in the lowest position of the platform 3 is still located below the latter in such a manner that the first part 41 actually does run vertically for a short distance. The term vertical herein is to be interpreted very widely—the direction of the first part 41 must include at least one vertical proportion; to this extent, a vertically running first part 41 is equivalently also to be understood to be a obliquely disposed first part. Such solutions are also part of the disclosure.

The site stands 31*a*, 31*b* at a short spacing from the front edge 39 supports a further, second, roller 51*a*, 51*b* (hereunder also referred to as the front roller 51*a*, 51*b*, because said roller 51*a*, 51*b* in the variants shown here are located in the front region 11 of the device 1 so as to face the entry 12). The front edge 39 herein is located on the side of the platform 3 that is opposite the terminal edge 38. The roller 51*a* is assigned to the side stand 31*a*, the roller 51*b* is assigned to the side stand 31*b*. The rollers 51*a*, 51*b* also serve for deflecting the synchronization traction element 4*a*, 4*b*. It is to be noted that the synchronization traction element 4*a* is assigned to the side stand 31*a*, and the synchronization traction element 4*b* is assigned to the side stand 31*b*.

The second part 42 of the synchronization traction element 4 that follows substantially the longitudinal extent of the platform 3 thus extends between the two rollers 50*a* and 51*a* of the side stand 31*a*, or between the rollers 50*b* and 51*b* of the side stand 31*b*, respectively.

The synchronization traction element 4 is guided around the top at the rear roller 50*a* so as to deflect the vertically running first part 41 to the second part 42 which run so as to be substantially horizontal. The synchronization traction element 4 is guided from at the front roller 51*a*, on account of which the second part 42 of the synchronization traction element 4 is diverted to the third part 43 which runs so as to be substantially vertical. The free end 49 on the third part 43 is secured in the fixing point 19.

It is to be noted that the rotation axes of the front roller 50*a* and of the rear roller 51*a* on the respective side stand 31*a* are approximately level in terms of height and the profile of the second part 42 of the synchronization traction element 4 is therefore somewhat inclined in relation to the horizontal, this according to the disclosure however still being comprised by the term "horizontally running".

The fixing point 19 is also flexibly selectable in terms of the position thereof. For example, it is provided that the device 1 is installed in a pit, and in this instance it is possible for the fixing point 19 to be provided on the wall of the pit. However, it also possible for the fixing point 19 to be located on an element of the device 1 (not shown here); said element can be part of the frame of the device 1, for example. However, the fixing point 19 is expediently chosen such that said fixing point 19 in the highest position of the platform 3 is still located above the platform 3. In general, the vertical spacing of the two fixing points 18, 19 is somewhat larger than the lift of the platform 3. The length of the synchronization traction element 4 therefore is equal to at least the vertical spacing of the fixing points 18, 19 plus the horizontal spacing of the front roller 51*a* from the rear roller 50*a*.

One advantage of the disclosure, per an embodiment, lies in that the embodiment of the frame of the device 1 is significantly facilitated on account of the guiding of the synchronization traction element 4 in the manner of a double L, divided into the three parts 41, 42, and 43, since part of the weight of the platform 3 and also of the vehicle or goods parked on the platform 3 is dissipated into the building in the fixing point 19. The device 1 presented here therefore relies on a relatively minor steel construction, this significantly lowering the manufacturing costs.

The substantial effect of the disclosure lies in that the two rear rollers 50*a*, 50*b* are connected to one another by the synchronization shaft 5. It is obvious that the length of the first part 41 is increased or decreased in a lifting or lowering movement of the platform 3, and in analogous manner the length of the third part 43 is decreased or increased, whereas the length of the central, second, part 42 which is located between the front roller 50*a* and the rear roller 51*a* remains unchanged, the synchronization traction element 4 however moving in said region. A relative movement of the synchronization traction element 4 in terms of the rear rollers 50*a*, 50*b* takes place. Of course, a relative movement toward the front rollers 51*a* and 51*b* also takes place, said front rollers 51*a* and 51*b* being likewise set in rotation on account thereof. Since the rollers 50*a*, 50*b* cause a deflection of the synchronization traction element 4, said rollers 50*a*, 50*b* are set in rotation by virtue of the lifting or lowering movement of the platform 3. The rollers 50*a*, 50*b* are secured at a rigid angle on the synchronization shaft 5, on account of which a mechanically fixed coupling of the two synchronization traction element 4*a*, 4*b* results. The rotation of the rollers 50*a*, 50*b* is mutually synchronized, and therefore the movement of the respective synchronization traction element 4*a*, 4*b* is also synchronized.

A non-uniform lifting or lowering movement of the lifting installation 2, which in the proposal in the prior art would have led to tilting or canting of the platform 3 in the device 1, is counteracted and compensated on account of this rigid mechanical coupling, and a jolt-free permanent operation is thus achieved, on the one hand, and on the other hand, the wear and tear on such a device 1 is thus minimized and the availability of the latter is significantly increased.

In the exemplary embodiment shown in FIG. 1, the synchronization shaft 5 is located in the rear region 10 of the platform 3, or of the device 1, respectively, on the side of the device 1 that faces away from the entry region 12. Therefore, the synchronization shaft 5 is also located in the immediate proximity of the lifting installation 2, in particular in the immediate proximity of the holding points 30*a*, 30*b* where the traction element 28 of the lifting element 2 engages. The spacing of the rotation axis 59 of the synchronization shaft 5 from the respective holding points 30*a*, 30*b* is less than 30%, preferably less than 15%, particularly preferably less than 10% or 5% of the overall length of the platform (this being the spacing of the front edge 39 from the terminal edge 38).

However, this exemplary embodiment does not preclude that the disclosure also comprises a solution in which the synchronization shaft 5 is located in the front region 11 of the platform 3, or of the device 1, respectively, and connects the front rollers 51*a* and 51*b* to one another. In this solution, the platform 3 is located so as to be substantially between the synchronization shaft 5 and the lifting installation 2 which is disposed, for example, on the opposite side, herein the rear region 10.

Figure 3:
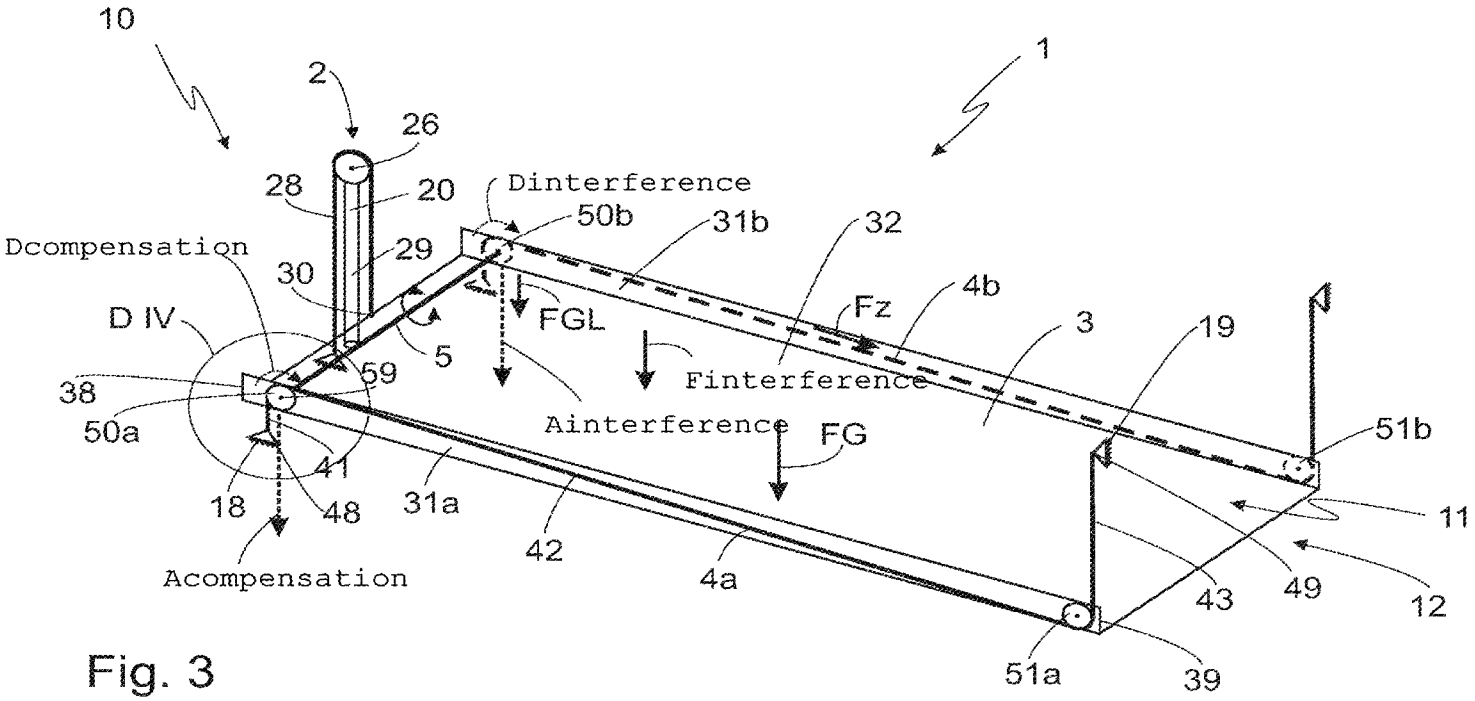
FIG. 3 schematically shows forces and moments in one embodiment of the disclosure in a perspective view.

It is also to be noted that the proposal according to the disclosure also comprises solutions in which the lifting installation 2 is not disposed twice in a redundant manner but is provided as the single, central, lifting installation 2. Such an embodiment is shown in FIG. 3, for example.

A form-fitting interaction between the synchronization traction element 4*a*, 4*b* and the respective rollers 50*a*, 50*b*, 51*a*, and 51*b* is provided, per an embodiment. This is specifically favorable in the rigid transmission of the moments between the two sides of the platform 3 by way of the synchronization shaft 5. It is therefore expedient for the synchronization traction element 4*a*, 4*b* to be implemented as a chain which is preferably designed for traction, and for the rollers 50*a*, 50*b*, 51*a*, and 51*b* to be configured as pinions or chain wheels.

The disclosure however also comprises solutions in which a force-fitting connection is provided between the synchronization traction element 4*a*, 4*b* and the rollers 50*a*, 50*b*, 51*a*, and 51*b*. The solutions are also equivalent to the concept proposed here. Therefore, ropes or else belts, optionally also belts equipped with teeth or cams, can be used; the rollers can correspondingly have conical or prismatic depressions so as to significantly increase the friction.

FIG. 2 shows a construction which is substantially identical to the construction in FIG. 1, wherein only the points of differentiation will be discussed herein. The other functions, properties, or else equivalent replacement means and considerations as set forth in the context of FIG. 1 can likewise also be used in FIG. 2 and are considered as conjointly disclosed.

As opposed to FIG. 1, no holding points 30*a*, 30*b* for the traction element 28 are provided in the rear region 10 of the platform 3 in FIG. 2. A separate fixing point 18 for the synchronization traction element 4*a*, 4*b* is also absent in FIG. 2. The reason therefore is that the traction element 28 and the synchronization traction element 4*a*, 4*b* in FIG. 2 are configured so as to be integral and specific portions of said integral component 6 serves primarily as the traction element 28, or the synchronization traction element 4*a*, 4*b*, respectively, on the one hand. On account of these two functions being combined, an additional fixing point for the synchronization traction element can be dispensed with.

This combined traction/synchronization traction element 6 at the one end 60 thereof is secured in the fixing point 25. This corresponds to the embodiment as in FIG. 1. As has already been explained, this fixing point 25 is provided so as to be vertically below the deflection roller 26. A first portion 61 of the combined traction/synchronization traction element 6 from the fixing point 25 extends upward to the deflection roller 26 and is deflected on the latter.

This is adjoined by a second portion 62 of the combined traction/synchronization traction element 6 which runs vertically downward and which is then deflected on the lower side about the rear roller 50*a* to a vertical direction. This second portion 62 corresponds to the first part 41 of the synchronization traction element 4. The first portion 61 and the second portion 62 of the combined traction/synchronization traction element 6 in terms of function herein corresponds to the traction element 28. The second portion 62 of the combined traction/synchronization traction element 6 has a dual function, being assigned to both the traction element 28 as well as to the synchronization traction element 4.

The third portion 63 of the combined traction/synchronization traction element 6 runs between the rear roller 50*a* and the front roller 51*a* and corresponds to the second, central, portion 42. At the front roller 51*a*, the combined traction/synchronization traction element 6 is guided from below onto the roller 51*a* and deflected from the horizontal back to a direction which runs vertically upward. This is then adjoined by the fourth portion 64 of the combined traction/synchronization traction element 6, said fourth portion 64 corresponding to the third part 43 of the synchronization traction element 4. The end 65 of the combined traction/synchronization traction element 6 is secured at the fixing point 19.

The arrangement of the fixing point 19 is again chosen such that said fixing point 19 is above the upper position of the lifted platform 3.

The platform 3, preferably at the respective corners thereof, thus at the ends of the stands 31*a*, 31*b*, possesses the rollers 50*a*, 50*b*, 51*a*, and 51*b*. It can be readily seen that the combined traction/synchronization traction element 6 forms a substantially U-shaped loop and the platform 3 by way of the rollers 50*a*, 50*b*, 51*a*, and 51*b* thereof is mounted in said combined traction/synchronization traction element 6. It is suitable that the combined traction/synchronization traction element 6 is located on both sides of the platform 3 and the embodiment in terms of said combined traction/synchronization traction element 6 is identical on both sides of the platform 3.

Rollers 50*a* and 50*b* which are mutually opposite on the platform 3 are also connected by the synchronization shaft 5 in the exemplary embodiment according to FIG. 2; here too, the rollers 50*a* and 50*b* are a synchronization coupling between the two sides of the platform 3. As is shown in FIG. 2, the synchronization shaft 5 in this exemplary embodiment is disposed in the rear region 10 of the device 1, in immediate proximity of the lifting installation 2. The spacing between the mounting location of the roller 50*a*, 50*b* and the terminal edge 38 is less than 30%, preferably less than 15%, particularly preferably less than 10 or 5% of the overall length of the platform 3 (this being the spacing of the front edge 39 from the terminal edge 38).

The same advantages as has already been set forth in the upper part of the description and in particular in the context of FIG. 1 are also derived in this exemplary embodiment. It is suitable that the synchronization shaft 5 can connect the two front rollers 51*a*, 51*b* also in the exemplary embodiment according to FIG. 2, and the platform 3 can thus be disposed between the synchronization shaft 5 and the lifting installation 2 so as to achieve this synchronization effect here too.

Instead of a redundant dual arrangement of the lifting installation 2, a central lifting installation is alternatively provided also in the exemplary embodiment according to FIG. 2.

In both exemplary embodiments according to FIGS. 1 and 2, the entry region 12 can alternatively also be disposed between the two lifting installations 2 (not shown). Such a proposal is also part of the disclosure.

FIG. 3 in a perspective view schematically shows forces and moments in one embodiment of the disclosure. The correlations illustrated and described hereunder between the weights, forces, and moments in analogous manner apply also to other embodiments of the disclosure.

The weight force $F_G$ which represents the weight of a vehicle ideally parked so as to be centric on the platform is illustrated by an arrow in the center of the platform face 32. Said weight force $F_G$ in the center of gravity which here is ideally located in the symmetry axis, or in the central axis, respectively. This represents an ideal case for a perfectly parked vehicle on a corresponding platform, the platform 3 being symmetrically stressed. In this state, no synchronization shaft 5 is required since the two lateral ends move in an identical manner in this ideal case (without taking into account any friction).

The real case is illustrated by adding a further force which does not engage in a manner symmetrical to the platform 3, and is created by a vehicle which is not parked so as to be centric, for example. This further force is referred to as $F_{interference}$ and can be seen to the left behind the weight force $F_G$. The platform 3 is stressed unilaterally in the rear region on account of said interference force $F_{interference}$. On account of the platform 3 being unilaterally stressed in the rear region by $F_{interference}$, said platform 3 without the counteraction of the mechanism for the synchronization would drop down further than in the front region. The result would be an obliquely standing platform 3. On account of an obliquely standing platform 3, jamming or canting would result in the vertical movement of said platform 3, which in a continuing movement would lead to damage to the parking device.

In order for the oblique position of the platform 3 caused by the interference force $F_{interference}$ to be compensated, the synchronization shaft 5 having the rollers 50*a*, 50*b* assembled in a rotationally fixed manner thereon is provided. The synchronization shaft 5 is rotatable on the platform 3, but mounted in a locationally fixed manner.

In the case illustrated in FIG. 3, the interference force $F_{interference}$ ensures the rear left corner of the platform 3 and thus also the roller 50*b* to slightly sink. This sinking $A_{interference}$ is symbolized by a dashed arrow.

The roller 50*b* engages with the synchronization traction element 4*b* which is under tension. To this end, the synchronization traction element 4*b* can be embodied as a roller chain, for example, and the roller 50*b* as a pinion having a matching toothing. On account of this engagement between the roller 50*b* and the synchronization traction element 4*b*, the roller 50*b* on account of the sinking $A_{interference}$ is set in a rotating movement $D_{interference}$ which is directed toward the right. Said rotating movement $D_{interference}$ of the roller 50*b* by way of the synchronization shaft 5 is transmitted to a rotating movement $D_{compensation}$ of the second roller 50*a* which is rigidly disposed so as to be opposite on the synchronization shaft 5. Since the second roller 50*a* in turn engages with the second compensation traction element 4*a*, the rotating movement $D_{compensation}$ is converted to a sinking $A_{compensation}$ of the left front corner, or the sinking $A_{interference}$ is reduced in such a manner that the lowering movement at the two lateral ends is identical again, respectively.

Any unilateral sinking of the platform 3 is immediately compensated by the interaction of the synchronization traction elements 50*a*, 50*b* and the synchronization shaft 5 and the rollers 50*a*, 50*b* disposed on the latter, such that no oblique position can arise and the issues described above are prevented. The compensation shaft 5 having two rollers 50*a*, 50*b* which are disposed so as to be rotationally fixed on the latter and which engage with the two synchronization traction elements 4*a*, 4*b* represents a mechanism which is of simple construction and therefore is very reliable. In a movement of the platform 3, the synchronization shaft 5 ensures a uniform movement of the two sides of the platform 3.

It has been surprisingly demonstrated herein that an arrangement of such an synchronization shaft 5 between the two synchronization traction elements 4*a*, 4*b* alone is sufficient for a synchronization also in terms of the two sides of the platform 3. The two synchronization traction elements 4*a*, 4*b* which are tensioned by the weight force $F_G$ alone are suitable for absorbing or supporting, respectively, rotating movements of the two rollers 50*a* and 50*b*. No further elements which are disposed in a locationally fixed manner are really required for supporting a transmission of rotating movement and moments from one roller 50*a* to another roller 50*b* by way of the synchronization shaft 5. For example, it is not necessary for locationally fixed, vertically running, racks to be disposed in the immediate vicinity of the platform 3, the rollers 50*a*, 50*b*, embodied as gear wheels, for example, meshing in said racks.

A synchronization shaft 5 according to the disclosure engages only in the flexibly embodied synchronization traction elements 4*a*, 4*b* which however are under tension and does not engage in counterparts such as, for example racks, which are attached in a locationally fixed manner.

The precondition in order for the described mechanism to function is that the two synchronization traction elements 4*a*, 4*b* are under tension and act like a solid component, for example like a rack. This state under tension is the case when the tensile force $F_Z$ prevalent in the synchronization traction elements 4*a*, 4*b* is greater than the synchronization force $F_{G1}$ acting on the ends of the synchronization shaft 5. Said synchronization force $F_{G1}$ directly correlates with the interference force $F_{interference}$. By virtue of the fact that the interference force $F_{interference}$ is absorbed by a plurality of elements (at least by two synchronization traction elements 4*a*, 4*b* and by a lifting element 2), the synchronization force $F_{G1}$ acting on one end of the synchronization shaft 5 is at all times less than the interference force $F_{interference}$.

It has been found that the tensile force $F_Z$ in the synchronization traction elements 4*a*, 4*b* for realistic applications is at all times greater than the synchronization force $F_{G1}$. The described interaction of the elements in realistic applications thus functions at all times even without the provision of locationally fixed elements for supporting the synchronization movements.

One advantage of this embodiment lies in that the synchronization traction element 4, 4*a*, 4*b* henceforth assumes a plurality of tasks. First, said synchronization traction element 4, 4*a*, 4*b* ensures that the front end and the rear end of the platform move in a uniform manner. By virtue of the high tension absorbed by the synchronization traction element, said synchronization traction element also assumes the function of a rack and along the longitudinal extent thereof permits a positionally accurate compensation of the platform movement on the left side and the right side. The synchronization traction element herein is expediently configured as a chain, wherein it has been found that a back-locked chain is not necessary here.

It is additionally provided that the synchronization traction element 4, 4*a*, 4*b* is also used as part of the lifting means, as this is shown in FIG. 2, for example.

Only one lifting element 2 which introduces the lifting force thereof so as to be centric on the narrow side of the platform 3 that is oriented toward the rear left is provided in FIG. 3. This embodiment is of simpler construction than the solutions in FIG. 1 and FIG. 2. By virtue of the synchronization shaft 5 and the functional mode thereof described above, a synchronization between the two sides of the platform by the lifting means 2 is provided despite only a single force introduction point.

Figure 4B:
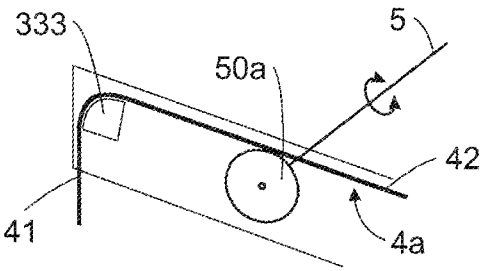
FIG. 4*b* shows a detailed view of the region marked as D IV in FIG. 3 in another embodiment.
Figure 4A:
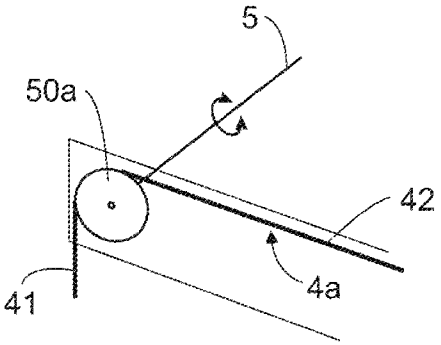
FIG. 4*a* shows a detailed view of the region marked as D IV in FIG. 3 in one embodiment.

FIG. 4*a* shows a detailed view of the region marked as D IV in FIG. 3. In this embodiment the roller 50*a* simultaneously has two functions. On the one hand, said roller 50*a* serves for absorbing or transmitting, respectively, rotating movements which are transmitted in the context of the function of the compensation shaft 5, as has been described in the context of FIG. 3. To this end, the roller 50*a* (and also the roller 50*b* on the opposite side) is disposed in the rotationally fixed manner (thus without a freewheeling action) on the compensation shaft 5.

Furthermore, the roller 50*a* performs the deflection of the synchronization traction element 4*a* from the horizontal part to the vertical part between the first part 41 and the second part 42. The roller 50*a* in the embodiment illustrated assumes the combined function of said two functions.

FIG. 4*b* shows the same region as in FIG. 4*a*, but the compensation shaft 5 in comparison to FIG. 4*a* is disposed so as to be further to the right, so as to be remote from the deflection point which deflects to the vertical. The roller 50*a*, 50*b* here preferably interacts in a form-fitting manner with the part of the synchronization traction element 4*a*, 4*b* that runs so as to be substantially horizontal. The roller 50*a* in the embodiment illustrated in FIG. 4*b* assumes only the function of absorbing or transmitting, respectively, rotating movements which are transmitted in the context of the function of the compensation shaft 5. The deflection of the synchronization traction element 4*a* between the first part 41 and in the second part 42 is assumed here by a deflection piece 333 which is different from the roller 50*a* and is disposed separately on the platform 3.

To this end, the deflection piece 333 does not mandatorily have to engage with the synchronization traction element 4*a*. The deflection piece 333 can also be embodied, for example, as a pinion which engages with the synchronization traction element 4*b* but is however mounted so as to be freely rotatable on the platform 3.

A reliable and stable function of the synchronization is provided in the lateral direction as well as in the longitudinal direction of the platform 3 also in the embodiment shown in FIG. 4*b*, having a functional separation between the deflection of the synchronization traction element and the transformation of the rotating movements required for the synchronization. The synchronization shaft 5 can thus also be disposed so as to be separate and remote from the point where the deflection of the synchronization traction element 4*a* from the first part 41 thereof to the second part 42 thereof takes place.

The claims filed now together with the application and filed later are without prejudice in terms of achieving wider protection.

Should closer examination, in particular also of the relevant prior art, herein indicate that one or the other feature is indeed favorable but not decisive in terms of the objective of the invention, a wording which no longer includes such a feature, in particular in the main claim, is of course envisaged already at this stage. Such a sub-combination is also covered by the disclosure of this application.

It is furthermore to be noted that the design embodiments and variants of the invention described in the various embodiments and shown in the figures can be mutually combined in an arbitrary manner. Individual features or a plurality of features herein can replace one another in an arbitrary manner. Said combinations of features are likewise included in the disclosure.

The back-references set forth in the dependent claims relate to the further configuration of the subject matter of the main claim by way of the features of the respective dependent claim. However, said back-references are not to be understood as a waiver in terms of achieving an independent objective protection for the features of the back-referenced dependent claims.

Features which have been disclosed only in the description, or else individual features from claims which comprise a plurality of features, may at any time be assumed by the independent claim/claims as being of significance relevant to the invention for delimiting the latter from the prior art, specifically also when such features have been mentioned in conjunction with other features, or achieve particularly favorable results in conjunction with other features.

All the features and advantages, including structural details, spatial arrangements and method steps, which follow from the claims, the description and the drawing can be fundamental to the invention both on their own and in different combinations. It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims. As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A device for parking a plurality of vehicles on top of one another, the device comprising:

at least one platform, a lifting installation able to lift and lower the at least one platform, a first synchronization traction element on a first side of the at least one platform, and a second synchronization traction element on an opposite second side of the at least one platform, wherein the first and second synchronization traction elements are able to synchronize respective movements of the first and second sides of the platform, each synchronization traction element having:

a first part in a first region of the at least one platform, a central, second part running along the at least one platform, a third part in a second region of the at least one platform opposite the first region, a first end fixed in the first region, and a second end fixed in the second region, wherein each synchronization traction element is guided on the at least one platform by at least one roller, and the at least one roller of the first synchronization traction elements is rotationally connected to the at least one roller of the second synchronization traction element by a synchronization shaft, and wherein the lifting installation comprises a piston rod supporting a deflection roller for the first or second synchronization traction element, the deflection roller being distinct from the at least one roller, and the first and second ends of the synchronization traction elements are fixed to a building which receives the device or to the device.

2. The device as claimed in claim 1, wherein the lifting installation is located at an end of the at least one platform and the synchronization shaft is provided in a region of the lifting installation.

3. The device as claimed in claim 2, wherein the synchronization shaft is provided at the end of the at least one platform.

4. The device as claimed in claim 1, wherein the lifting installation is centrally disposed and connected to the at least one platform at a rear region of said at least one platform, and one holding point which is provided for direction force from the lifting installation into the at least one platform is disposed so as to be centric between longitudinal sides of the at least one platform.

5. The device as claimed in claim 1, wherein the device has two lifting installations and the at least one platform is located between the two lifting installations.

6. The device as claimed in claim 1, wherein the lifting installation is formed by a lift drive and a lifter on which the lift drive acts or which interacts with the lift drive.

7. The device as claimed in claim 6, wherein the lifter engages directly or indirectly on the at least one platform or on a movable part of a frame that supports the at least one platform.

8. The device as claimed in claim 1, wherein at least one part of each synchronization traction element for lifting and lowering the at least one platform interacts with the lifting installation.

9. The device as claimed in claim 1, wherein the synchronization traction element is configured as a chain.

10. The device as claimed in claim 9, wherein the chain is a traction chain.

11. The device as claimed in claim 1, wherein each of the at least one roller is configured as a pinion or a chain wheel.

12. The device as claimed in claim 1, wherein the at least one roller on each side of the at least one platform includes one front roller in the second region and one rear roller in the first region, and the lifting installation is disposed in the first region, and the first part of each synchronization traction element extends upward from a fixing point in the first region to the deflection roller, the second part of each synchronization traction element extends between the one rear roller and the one front roller, and the third part extends upward from the one front roller to a further fixing point, and the synchronization shaft connects the two rear rollers to one another.

13. The device as claimed in claim 1, wherein the at least one roller on each side of the at least one platform has one front roller in the second region and one rear roller in the first region, and the deflection roller is provided between the one rear roller and a rear end of the at least one platform, and the first part of each synchronization traction element extends upward from a fixing point in the first region to the deflection roller, the second part of each synchronization traction element extends between the deflection roller and the one front roller, wherein the second part of each synchronization traction element between the deflection roller and the one front roller is operatively connected to the one rear roller, and the third part extends upward from the one front roller to a further fixing point, and the synchronization shaft connects the two rear rollers to one another.

14. The device as claimed in claim 1, wherein the at least one roller on each side of the at least one platform has one front roller in the second region and one rear roller in the first region, and the lifting installation is disposed in a region of the rear roller, and the synchronization traction element is guided from a fixing point to the one rear roller by way of the deflection roller above the one rear roller and thus forms the first part of each synchronization traction element, the second part of each synchronization traction element extends between the one rear roller and the one front roller, and the third part extends upward from the one front roller to a further fixing point, and the synchronization shaft connects the two rear rollers to one another.

15. The device as claimed in claim 1, wherein the lifting installation is centrally disposed.

* * * * *